US005243162A

United States Patent [19]

Kobayashi

[11] Patent Number: 5,243,162

[45] Date of Patent: Sep. 7, 1993

[54] TRANSPARENT TOUCH SWITCH

[75] Inventor: Masakazu Kobayashi, Iwaki, Japan

[73] Assignee: Alps Electric Co., Ltd., Tokyo, Japan

[21] Appl. No.: 754,860

[22] Filed: Sep. 4, 1991

[30] Foreign Application Priority Data

Sep. 4, 1990 [JP] Japan ..... 2-232346

[51] Int. Cl.[5] ..... H01H 1/10

[52] U.S. Cl. ..... 200/512; 200/514; 200/5 A

[58] Field of Search ..... 200/511, 512, 514, 515, 200/5 A; 427/110, 58

[56] References Cited

U.S. PATENT DOCUMENTS 3,911,215 10/1975 Hurst et al. ..... 178/18
4,017,697 4/1977 Larson ..... 200/5 A
4,317,013 2/1982 Larson ..... 200/5 A
4,336,529 6/1982 Buan ..... 200/5 A X
4,382,165 5/1983 Balash et al. ..... 200/512 X
4,901,074 2/1990 Sinn et al. ..... 200/512 X
4,965,421 10/1990 Epperson ..... 200/512 X

*Primary Examiner*—Henry J. Recla
*Assistant Examiner*—Glenn T. Barrett
*Attorney, Agent, or Firm*—Guy W. Shoup; David W. Heid

[57] ABSTRACT

An optically transparent touch switch is described. The switch is of the type which comprises a pair of glass sheets, transparent electrodes formed on one side of each glass sheet in such a way that the transparent electrodes are facing each other, and a spacer provided between the paired glass sheets to establish a given gap therebetween. The spacer is made of a dispersion which comprises an adhesive resin, spherical fine particles of a transparent resin, and hard fine particles of glass fibers having substantially the same diameter as a size of the spherical fine particles.

7 Claims, 1 Drawing Sheet

TRANSPARENT TOUCH SWITCH

BACKGROUND OF THE INVENTION

1. Field of the Invention

This invention relates to a transparent touch switch of the type which is set at the front side of display devices such as LCDS, CRTS and the like to make switching ON or OFF at an arbitrarily selected position on a display panel using the touch switch.

2. Description of Related Art

Typical of known transparent touch switches is one including transparent upper and lower electrodes which are facing each other through a spacer and can be electrically contacted when one of the electrodes is pressed. In one such switch, the electrodes are formed on glass sheets or plates, respectively. This type of switch is mainly used setting on a display face of an LCD (liquid crystal display device). More particularly, when an operator presses a given position on the transparent switch with the fingers after visual observation, the electrodes at the given position are contacted to turn the switch on.

FIGS. 2 and 3 show this type of known transparent touch switch whereas FIG. 2 shows a non-pressed state of the switch and FIG. 3 shows a pressed state.

In these figures, reference numeral 1 indicates a transparent upper electrode which is made, for example, of ITO and formed on a lower side of a thin upper glass sheet 2 by means such as vapor deposition, sputtering or the like technique. Reference numeral 3 indicates a transparent lower electrode made, for example of ITO and formed on an upper surface of a thick lower glass sheet 4 by a similar technique. The glass sheets 2, 4 are bonded with a spacer 5 while keeping a given space between the sheets 2,4. The spacer 5 is made of a transparent resin and is formed by dispersing spherical fine particles 6 of a resin such as Micro Pearl (available from Sekisui Fine Chemicals Co., Ltd.) in an adhesive 7 such as an epoxy resin and printing the dispersion in the form of dots. Subsequently, the spacer 5 is provided between the paired glass sheets 2,4 and hot-pressed, so that the glass sheets 2,4 are stacked and bonded with the adhesive 7 while keeping the given gap defined by the diameter of the spherical fine particles 6 of the resin.

The resultant transparent touch switch is disposed on a display face, for example, of an LCD (not shown). In operation, while watching the display face, an operator presses a selected portion on the upper glass sheet 2 within the display zone. By this, the pressed portion of the upper glass 2 is partially depressed, as shown in FIG. 3, so that the upper electrode 1 is contacted with the lower electrode 3, causing the switch to turn on. When the press force is removed, the upper glass sheet 2 is returned to the original position shown in FIG. 2 wherein the upper electrode 1 is detached from the lower electrode 3 to make an off state.

Besides, there is also known a transparent touch switch wherein bar-shaped hard particles made of glass fibers are used instead of the spherical resin fine particles and are dispersed in an adhesive material to make a spacer.

However, in the known touch switches where the gap between the paired glass sheets 2,4 is defined with the spherical resin fine particles 6, the spherical resin fine particles 6 are stressed to contain a repulsion force therein at the time of the hot pressing of the spacer 5. The repulsion force may eventually cause the adhesive material 7 to be cracked or broken after the hot-pressing. The cracks or breakage of the adhesive material 7 is disadvantageous in that light is irregularly reflected at the portion where cracked or broken, so that the spacer 5 which should be optically transparent becomes opaque.

With the case where hard fine particles are used instead of the spherical resin fine particles, bar or needle-like hard fine particles are unlikely to pass through a mask mesh, making it difficult to print the dispersion in an amount necessary for the spacer. This will result in stress concentration on the hard fine particles at the time of the hot pressing of the spacer 5, leading to the disadvantage that the particles are broken to cause the portion to be opaque or that the gap between the paired glass sheets is liable to be non-uniform along the sheets.

SUMMARY OF THE INVENTION

It is accordingly an object of the invention to provide an optically transparent touch switch which overcomes the disadvantages of the prior art touch switches.

It is another object of the invention to provide a transparent touch switch wherein a spacer is made of a dispersion, in an adhesive material, of spherical fine particles of a transparent resin and hard fine particles of a resin having a diameter substantially equal to a size of the spherical fine particles.

The above objects can be achieved, according to the invention, by an optically transparent touch switch of the type which comprises a pair of glass sheets, transparent electrodes formed on one side of each glass sheet in such a way that the transparent electrodes are facing each other, and a spacer provided between the paired glass sheets to establish a given gap therebetween. The spacer is made of a dispersion which comprises an adhesive resin, spherical fine particles of a transparent resin, and hard fine particles of glass fibers having substantially the same diameter as a size of the spherical fine particles.

When the spacer is made of the above-defined dispersion comprising two types of particles, the stress exerted on the spherical fine particles at the time of hot pressing is mitigated with the aid of the hard fine particles. Thus, the cracks or breakage of the adhesive material as would be otherwise caused by the repulsion force of the stressed fine particles can be beneficially prevented. In addition, the stress concentration on the hard fine particles can be avoided by means of the spherical fine particles, thereby preventing cracking of the hard fine particles.

PREFERRED EMBODIMENTS OF THE INVENTION

Figure 1:
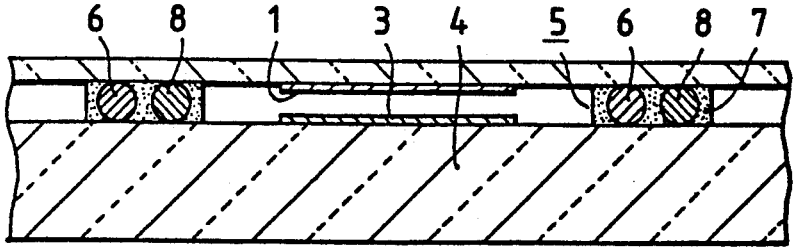
FIG. 1 is a schematic sectional view of a transparent touch switch in a non-pressed state according to one embodiment of the invention.

Reference is now made to FIG. 1, in which there is shown a sectional view of a transparent touch switch according to one embodiment of the invention in a no-pressed state. In the figure, like reference numerals as in FIGS. 2 and 3 indicate like parts or members.

Figure 2:
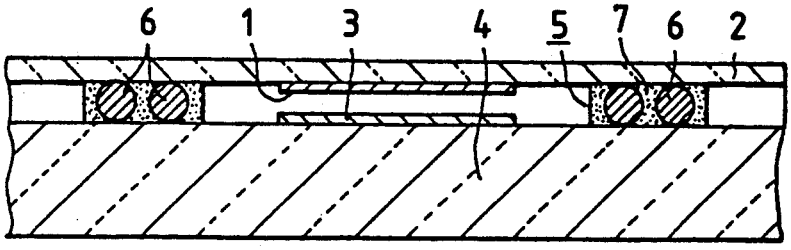
FIG. 2 PRIOR ART
FIG. 2 is a schematic sectional view of a known transparent touch switch in a non-pressed state.
Figure 3:
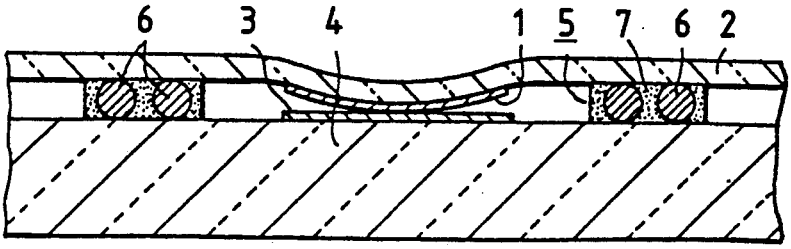
FIG. 3 PRIOR ART
FIG. 3 is a schematic sectional view of the switch of FIG. 2 but in a pressed state.

As shown in FIG. 1, a fundamental arrangement of the touch switch is similar to those shown in FIGS. 2 and 3. Accordingly, the differences from those of FIGS. 2 and 3 are described.

A spacer 5 of a transparent touch switch according to the invention is made of a dispersion, in an adhesive material 7 such as an epoxy resin, of spherical fine particles 6 of a transparent resin having a size of about 15 micrometers and needle or bar-like hard fine particles 8 having a diameter of about 15 micrometers and made of glass fibers. The spherical fine particles are available, for example, from Sekisui Fine Chemicals Co., Ltd. under the designation of Micro Pearl. The dispersion is printed in a dot form on either a transparent upper glass sheet 2 or a transparent lower glass sheet 4. The adhesive material is cured by hot pressing. The spherical fine particles 6 are dispersed in an amount of about 2.0% by weight of the adhesive material 7 and the hard fine particles 8 are dispersed in an amount of about 3.3% by weight of the adhesive material 7.

When the dispersion defined above is used as the spacer 5, the spherical fine particles 6 and the hard fine particles 8 function in mutual relation when the spacer 5 is provided between the upper glass sheet 2 having a transparent upper electrode 1 and the lower glass sheet 4 having a transparent lower electrode 3 and hot pressed. More particularly, the stress exerted on the spherical fine particles 6 at the time of the hot pressing is suppressed to an extent by the action of the hard fine particles 8. Accordingly, there is little possibility that the spherical fine particles suffer an excessive degree of depression with storage of a repulsion force in the particles. This leads to no cracks or breakage of the adhesive material after completion of the hot pressing. The stress concentration on the hard fine particles 8 at the time of the hot pressing is avoided by the presence of the spherical fine particles 6, with no possibility that the hard fine particles 8 are broken. This ensures the space 5 which is free of any opaque problem of the spacer involved in prior art, thus leading to a significant improvement in the yield of the switch.

Since the size of the spherical fine particles 6 and the diameter of the hard fine particles 8 are defined substantially at the same level, the cap between the paired glass sheets 2, 4 is controlled by the two types of particles. Accordingly, establishment of a given gap is ensured using only small amounts of the fine particles 6,8 in the adhesive material 7. If the needle or bar-like hard fine particles 8 alone are used to set a given gap, it is difficult to print the dispersion containing a necessary amount of the bar-like hard fine particles as set out before. This may result in a non-uniform gap along the glass sheets. In the embodiment of the invention, the spherical fine particles 6 are also used in combination, so that the gap can be established uniformly.

What is claimed is:

1. An optically transparent touch switch comprising:

a transparent first sheet and a transparent second sheet, at least one transparent first electrode disposed on a surface of said transparent first sheet and at least one transparent second electrode disposed on a surface of said transparent second sheet, a spacer connecting said first and second transparent sheets such that said first and second transparent electrodes are facing each other and a non-conductive gap is created between said first and second transparent electrodes, said spacer comprising a dispersion of transparent soft spacing particles and transparent hard spacing particles in a transparent adhesive material.

2. The optically transparent touch switch according to claim 1, wherein said transparent adhesive material is an epoxy resin.

3. The optically transparent touch switch according to claim 1, wherein said transparent soft spacing particles and said transparent hard spacing particles are, respectively, contained in amounts of 2.0% by weight and 3.3% by weight of said transparent adhesive material.

4. The optically transparent touch switch according to claim 1, wherein said transparent soft spacing particles are made of resin and said transparent hard spacing particles are made of glass.

5. The optically transparent touch switch according to claim 1, wherein said transparent soft spacing particles are spherical and said transparent hard spacing particles are fibers.

6. The optically transparent touch switch according to claim 5, wherein said transparent soft spacing particles and said transparent hard spacing particles have substantially the same diameter.

7. The optically transparent touch switch according to claim 6, wherein said transparent adhesive material is an epoxy resin, said transparent soft spacing particles are made of resin and contained in an amount of 2.0% by weight of said transparent adhesive material, and said transparent hard spacing particles are made of glass and contained in an amount of 3.3% by weight of said transparent adhesive material.

* * * * *